US010064463B2

(12) United States Patent
Kreis et al.

(10) Patent No.: US 10,064,463 B2
(45) Date of Patent: Sep. 4, 2018

(54) POLE HANDLE WITH HANDLE LOOP

(71) Applicant: LEKISPORT AG, Baar (CH)

(72) Inventors: Wladimir Kreis, Kirchheim (DE); Christoph Doll, Kirchheim (DE); Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 15/504,381

(22) PCT Filed: Sep. 4, 2015

(86) PCT No.: PCT/EP2015/070239
§ 371 (c)(1),
(2) Date: Feb. 16, 2017

(87) PCT Pub. No.: WO2016/037940
PCT Pub. Date: Mar. 17, 2016

(65) Prior Publication Data

US 2017/0231339 A1 Aug. 17, 2017

(30) Foreign Application Priority Data

Sep. 9, 2014 (CH) ..... 1358/14

(51) Int. Cl.
*A45B 9/02* (2006.01)
*A63C 11/22* (2006.01)

(52) U.S. Cl.
CPC ..... *A45B 9/02* (2013.01); *A63C 11/222* (2013.01); *A63C 11/227* (2013.01); *A45B 2009/025* (2013.01); *A45B 2200/055* (2013.01)

(58) Field of Classification Search
CPC ..... A45B 9/02; A45B 3/00; A45B 2009/025; A45B 2200/055; A45B 2009/002; A63C 11/222; A63C 11/22; A63C 11/227
(Continued)

(56) References Cited

U.S. PATENT DOCUMENTS 5,092,629 A * 3/1992 Bagneres ..... A41D 19/0037 2/161.1
5,312,134 A * 5/1994 Goode ..... A41D 19/0037 2/160
(Continued)

FOREIGN PATENT DOCUMENTS

DE 197 51 978 A1 5/1999
DE 299 06 612 U1 8/2000
(Continued)

OTHER PUBLICATIONS

International Preliminary Report on Patentability with translation of Written Opinion dated Mar. 23, 2017, issued by the International Searching Authority in application No. PCT/EP2015/070239.
(Continued)

*Primary Examiner* — Winnie Yip
(74) *Attorney, Agent, or Firm* — Sughrue Mion, PLLC

(57) ABSTRACT

The invention relates to a hand-retaining device (70) for securing to a pole handle (1), comprising an insert opening (71) for the hand, a first exit opening (72) for the back of the hand, and a second exit opening (73) for the thumb. The hand-retaining device according to the invention further has a first elastic strip (74) which is led between the thumb and the other fingers and on which a coupling element (79) is provided that can be secured in or on the pole handle in a removable mechanism in a self-latching manner. The invention further relates to a pole handle to which the handle loop according to the invention can be optimally secured.

26 Claims, 6 Drawing Sheets

(58) Field of Classification Search
USPC ..... 135/65, 72; 280/819, 821–822; 2/159–160, 162, 161.1, 161.2, 161.4, 2/161.5, 16–17; 473/205
See application file for complete search history.

(56) References Cited

U.S. PATENT DOCUMENTS

| | | | | | |
|---|---|---|---|---|---|
| 5,328,205 | A * | 7/1994 | Bacharach | A63C 11/222 | 135/72 |
| 5,470,108 | A * | 11/1995 | Goode | A63C 11/222 | 135/75 |
| 5,887,282 | A | 3/1999 | Lenhart | | |
| 5,988,681 | A * | 11/1999 | Vesalainen | A63C 11/222 | 2/160 |
| 6,386,588 | B1 * | 5/2002 | Young | A44B 11/12 | 280/821 |
| 7,014,210 | B2 * | 3/2006 | Manninen | A63C 11/222 | 280/821 |
| 7,226,084 | B2 * | 6/2007 | Lenhart | A63C 11/222 | 280/819 |
| 7,322,612 | B2 * | 1/2008 | Trinen | A63C 11/222 | 280/819 |
| 7,661,713 | B2 * | 2/2010 | Panizza | A63C 11/222 | 280/821 |
| 7,690,085 | B2 * | 4/2010 | Lenhart | A63C 11/222 | 16/436 |
| 8,579,328 | B2 * | 11/2013 | Dobner | A45B 9/02 | 280/819 |
| 2010/0218347 | A1 | 9/2010 | Lenhart | | |

FOREIGN PATENT DOCUMENTS

| | | | |
|---|---|---|---|
| DE | 10 2006 008 066 | A1 | 10/2006 |
| EP | 2 168 641 | A1 | 3/2010 |
| WO | 2006/066423 | A1 | 6/2006 |
| WO | 2006/066424 | A1 | 6/2006 |

OTHER PUBLICATIONS

International Search Report of PCT/EP2015/070239 dated Nov. 6, 2015.

* cited by examiner

POLE HANDLE WITH HANDLE LOOP

CROSS REFERENCE TO RELATED APPLICATIONS

This is a National Stage of International Application No. PCT/EP2015/070239 filed Sep. 4, 2015, claiming priority based on Swiss Patent Application No. 01358/14 filed Sep. 9, 2014, the contents of all of which are incorporated herein by reference in their entirety.

TECHNICAL SCOPE

The present invention relates to a hand-retaining device having a coupling element and to a pole handle having a hook-like device for the self-locking fastening of such a hand-retaining device, in particular for a ski pole, a Nordic walking pole, a cross-country pole or a hiking pole.

PRIOR ART

The prior art, for example DE 299 06 612 U1, discloses either pole handles which are engaged around by the user in a direction transversely to the pole longitudinal axis, or pole handles with a pommel, such as, for example, from DE 10 2006 008 066 A1, which are only suitable to be engaged around from above.

EP 2 168 641 describes an ergonomic pole handle which is suitable to be engaged around in both ways. Said pole handle makes it possible for the user to use it in a manageable and ergonomic manner not only in the engaged-around hand position known of ski poles from a direction substantially transverse to the pole longitudinal axis, but additionally also for support or pushing away by means of the effect of a force from above, which is useful above all, for example, in the case of sloping ground. The pole handle described there comprises a device for the adjustable fastening of a hand strap which is conventional per se. To this end, on the rear pole handle region, the handle head comprises a recess for receiving a hand-retaining device or a clamping element connected to a hand-retaining device. In this case, the device comprises an eccentric element which is rotatable and/or pivotable about an axis. Consequently, the fastening means that is guided in the fastening region between the top surface of the eccentric element and a stationary abutment, or a hand strap or a clamping element fastened thereon, is clamped between the eccentric element and the abutment as a result of rotating or pivoting the eccentric element in the locking rotational direction, the eccentric element being rotatable or pivotable by means of a lever or hinged handle for clamping the hand-retaining device. The length of the hand strap is held here so as to be adjustable, the hand strap, however, is fixedly fastened on the pole handle.

REPRESENTATION OF THE INVENTION

The invention comes into play here. The object accordingly underlying the invention is to provide a hand-retaining device for a pole handle which is improved compared to the prior art. In particular, it involves improving a hand-retaining device for coupling to a pole handle for walking poles, trekking poles, alpine poles, cross-country poles and Nordic walking poles, in particular also for pole handles with a domed handle head which is suitable to be engaged around from above. It is a further object to provide a pole handle which, among other things, is able to be used but does not have to be used, with such a hand-retaining device.

The object is achieved, among other things, by a hand-retaining device that serves for fastening on a pole handle, in particular preferred for a ski pole, a Nordic walking pole, a cross-country pole or a hiking pole, such as, for example, described in EP 2 168 641. The hand-retaining device according to the invention is particularly suitable for fastening on a pole handle as described further below, but is, however, an invention in its own right independent of the pole handle described below and can consequently also be used for fastening on differently developed pole handles. WO 2006/066423 and WO 2006/066424 disclose a pole handle or a hand-retaining device suitable for coupling to the pole handle having a self-locking mechanism. First of all, it does not appear possible to utilize such a coupling mechanism for a pole handle which can be engaged around both from above and from the side, such as, for example, described in EP 2 168 641 as the short distance defined by the coupling element between the retaining mandrel and the hand-retaining device prevents the user from engaging around the pommel from above. The hand-retaining device proposed here or rather the pole handle proposed here allow this in a surprisingly practical and efficient manner, however, with the corresponding adaptations.

The hand-retaining device includes an insertion opening for the hand, a first exit opening for the back of the hand and a second exit opening for the thumb, and also comprises a first strip which is guided between the thumb and the other fingers, on which is provided a coupling element which can be fastened in a self-locking manner in a releasable mechanism in and/or on the pole handle. The core of the invention is that the first strip is realized, at least in regions, in an elastic manner. The elasticity of the first strip, on which the coupling element is fastened, enables a user to engage around the handle head of the pole from above even with the hand-retaining device fastened on the pole handle, i.e. to change from a lateral engaging round position of the handle body into an engaging-around position of the handle head from above and back depending on what the terrain or the walking movement requires. The first strip is preferably elastic in a region of the hand-retaining device on the side of the exterior surface of the hand, i.e. in a region which extends from the coupling element on the side of the top surface of the hand. In contrast, it is preferred when the region of the first strip which extends proceeding from the coupling element to the region of the hand-retaining device on the side of the interior surface of the hand is realized in a non-elastic manner, for example in the form of single-layer or multi-layer webbing which forms said non-elastic region of the first strip or is sewn onto the first strip in the region on the side of the interior surface of the hand. When the hand is pulled, the strain on the hand strap, especially in the region of the hand strap on the side of the interior surface of the hand, is downward and when the hand moves it is upward especially in the region on the side of the exterior surface of the hand. It is consequently preferred that when the hand is moved downward, the length of the first strip is not increased or is hardly increased, whilst when the hand is moved upward (such as, for example, when engaging around the handle head from above) the length of the first strip is greatly increased such that the handle head is able to be engaged around comfortably from above.

When a force of 10N is applied, a strip of a length of 5 cm is to be designated as elastic when at said force it experiences a change in length of at least 3 mm, preferably at least 5 mm, 10 mm or even 15 mm or 20 mm. In contrast to this, "non-elastic" in the context of said invention means that when the abovementioned force of 10 N is applied to a strip of the same length, elongation of less than 3 mm, preferably of less than 2 mm and in particular preferably of less than 1 or 0.5 mm is effected.

According to a preferred embodiment, the hand-retaining device, between the thumb and the other fingers or between the first exit opening for the back of the hand and the second exit opening for the thumb, comprises a second strip which connects a region of the hand-retaining device on the side of the exterior surface of the hand and a region of the hand-retaining device on the side of the interior surface of the hand preferably in one piece. In this case, the first strip overlaps the second strip thereby forming a space. Said gap or separation is necessary so that when the handle head is engaged around from above, the hand strap remains in its normal fit on the hand, whilst, independently of this, the length of the first strip can be stretched as a result of its elasticity and consequently the distance between the coupling element and the hand can be increased. Both strips are loosely placed in the region below the fastening element such that the head of the handle is able to be engaged around. In the subsequent extension of the second strip, it is fastened on the hand-retaining device on the side of the inside surface of the hand in order to be able to absorb tensile forces in the intended direction of stress.

According to a further preferred embodiment, the second strip is multi-layered in the region on the side of the exterior surface of the hand, i.e. realized from at least two preferably non-elastic material layers, and the first elastic strip extends in the region on the side of the exterior surface of the hand between two such material layers of the second strip. The first elastic strip is consequently guided to a certain extent through a tunnel or channel which is formed from the second strip preferably in the region on the side of the exterior surface of the hand. In this case, it can be advantageous when the first elastic strip in the non-extended state does not project out of the tunnel or only projects out a little, and only projects out of the tunnel when the hand of the user engages around the pole handle from above, i.e. when the first elastic strip is acted upon or stretched.

The hand-retaining device, in this case, can be realized as a hand strap or in the form of a glove. In the event of a glove, the coupling element is arranged on a first strip which overlaps the strip or the glove portion, run between the thumb and the index finger. In this case, the strip which runs between the thumb and the index finger and forms part of the glove is to be understood as the second strip.

The first strip is preferably a strip which is fastened on the hand-retaining device and is formed at least in a first region from an elastic or flexible, preferably rubber elastic material. For example, the first elastic region of the elastic strip can be formed from an elastic band or rubber band or a non-woven textile material with elastic and non-elastic regions and/or constituents. The first elastic region is preferably arranged in the region on the side of the exterior surface of the hand. It is also conceivable for the entire first strip to be realized from an elastic band which, however, in the case of a non-elastic region, for example in the region of the hand strap on the side of the interior surface of the hand, is sewn to non-elastic webbing in said non-elastic region.

In a particularly advantageous embodiment, the first strip connects the region of the hand-retaining device on the side of the exterior surface of the hand to the region of the hand-retaining device on the side of the interior surface of the hand, or provides a further connection between said two regions in addition to the second strip. The first strip is fastened on the hand-retaining device preferably on its first end on the side of the exterior surface of the hand and on its second end on the side of the interior surface of the hand, preferably as a result of sewing.

In this case, it is particularly preferred when the hand-retaining device is realized in part in multiple layers in a region on the side of the exterior surface of the hand. In such a case, the first strip is fastened, preferably sewn, on the hand-retaining device preferably on its first end on the side of the exterior surface of the hand, which faces the insertion opening for the hand on the top surface of the hand or exterior surface of the hand, between a first material layer and a second material layer. The seam, in this case, can project through all the material layers of the hand-retaining device. In this case, it is advantageous when the region of the hand-retaining device on the side of the exterior surface of the hand comprises a slot or an insertion opening, through which the first strip, or the elastic region of the first strip can enter and be guided up to its fastening as it were in a "tunnel" between two material layers. The portion of the elastic region of the first strip placed outside the tunnel, measured from the coupling element up to the entry of the first strip into the slot or the insertion opening, is preferably smaller than the tunneled portion which runs under the top material layer of the region of the hand-retaining device on the side of the exterior surface of the hand.

It is particularly advantageous when the first strip, or the end thereof on the side of the exterior surface of the hand, is fastened close to the insertion opening for the hand on the region of the hand-retaining device on the side of the exterior surface of the hand. As a result, the length of the elastic region of the first strip can be maximized and consequently a maximum engaging-around position of the handle head from above is made possible without the elastic restoring force of the elastic strip being felt to be uncomfortable, or the restoring force pulling the user hand back into the lateral engaging-around position. The distance between the fastening or the seam and the edge of the hand-retaining device adjoining the insertion opening for the hand, in this case, is a maximum of between 0.5 and 5 cm, preferably a maximum of between 0.5 and 3 cm. In particular, said fastening is at a distance of between 1.5 and 2.5 cm from said insertion opening for the hand. The distance between the coupling element and the fastening of the first strip in the region on the side of the exterior surface of the hand is preferably greater than that between the coupling element and the fastening of the first strip in the region of the hand-retaining device on the side of the interior surface of the hand.

The first strip in a region between its fastening in the region of the hand-retaining device on the side of the exterior surface of the hand on its first end on the side of the exterior surface of the hand and its fastening in the region of the hand-retaining device on the side of the interior surface of the hand on its second end on the side of the interior surface of the hand, is preferably not fastened on the hand-retaining device, preferably at least in a region of the coupling element or in the vicinity thereof. The first strip consequently sticks out from the main body of the hand-retaining device in a region in which it overlaps the second strip, which connects the region on the side of the interior surface of the hand in one piece to the region of the hand-retaining device on the side of the exterior surface of the hand, thereby forming a space. In the embodiment mentioned further above, where the second strip is realized in multiple layers in the region on the side of the exterior surface of the hand, and where the first elastic strip extends in the region on the side of the exterior surface of the hand between two such material layers of the second strip, said space can be limited to a minimum, i.e. the first strip and the second strip touch one another in said overlap region possibly in regions, but are at least not connected together in said overlap region, or are realized as two separate elements in said overlap region, or are displaceable relative to one another.

The coupling element can be realized, for example, as a toothed rigid element, as a hook-like device or a preferably flexible strap-shaped/ring-shaped or eye-shaped device, wherein the coupling element is realized in a particularly preferred manner as a flexible strap or eye and is essentially produced from a low-stretch, where applicable plaited material, or from a braided or coated wire-like material. The strap or eye preferably consists of a cable or stirrup or a flexible plastics material cord with inherent rigidity. In the event of the strap or eye, the hand-retaining device is particularly suitable for fastening on a pole handle as it comprises a hook-like device on which the hand strap can be coupled.

The hand-retaining device preferably comprises a variably securable first fastening device in the region between the insertion opening for the hand and the first exit opening for the back of the hand, for example by means of two complementary Velcro regions.

It is additionally also an object of the invention to provide an improved pole handle with a hook-like device for the fastening of a hand-retaining device. Said object is achieved in particular by a pole handle suitable for a pole, in particular in a preferred manner for a ski pole, a Nordic walking pole, a cross-country pole or a hiking pole, and comprises a handle body and a handle head with a hook-like device for the fastening of a hand-retaining device, particularly for the fastening of a hand-retaining device, in particular in the form of a hand strap or a glove. The pole handle according to the invention is an invention in its own right independent of the above-described hand-retaining device. The pole handle according to the invention can be used in combination with the hand strap according to the invention, however other hand-retaining devices with a strap-shaped or eye-shaped device can also be coupled to said pole handle. The handle head is preferably integrally molded onto the top handle body region, but can also be integrally molded onto a tube forming the central recess for the pole tube or fitted onto the top handle body region or the tube, or inserted into the tube. The hook-like device, in this case, is fastened on a separate locking module or forms part thereof. The locking module is insertable into a recess which is accessible from one hand side and/or from above, in particular a recess of the handle head which is accessible from above in the axial direction, and is fastenable in and/or on the handle head. Rotatable or displaceable latching means are arranged in and/or on the locking module in such a manner that a coupling element which is realized as a strap-shaped, ring-shaped or eye-shaped device, is essentially pushed from above into the hook-like device and is provided on the hand-retaining device, is fixed in a self-locking manner in or on the hook-like device and on the locking module.

The locking module is preferably fastened on the handle head by means of at least one first cross pin which is arranged transversely with respect to the longitudinal axis of the pole handle. According to a preferred embodiment, the locking module is additionally fastened on the handle head by means of a second cross pin. If the handle head comprises a cover, at least one of the cross pins preferably serves at the same time for fastening a cover on the handle head, as described below.

According to a next preferred embodiment, the handle head comprises a cover which is arranged on its top surface and is realized in a convex manner according to a particularly preferred embodiment and, for reinforcement, can comprise possible struts and/or shoulders and/or further reinforcing and/or guiding structures. The cover is preferably realized so as to be removable. To this end, the cover can comprise for example, a latching lug which projects into the interior of the head region and is fixable there in a self-locking manner in a structure provided for this purpose. As an alternative to this, the handle head can also comprise a latching lug which can hook or latch into an undercut of the cover when the cover is mounted. The cover, on its rear end facing a direction which is opposite to the running direction, preferably comprises two legs which, in the rest position, extend substantially parallel to the longitudinal axis of the pole handle or to a pole longitudinal axis. Said legs can comprise a recess each, through which a second cross pin or axial pin can be guided transversely with respect to the pole longitudinal axis and to the running direction, preferably parallel to a transverse axis of the handle head. The two recesses of the legs, in this case, are preferably in alignment with two recesses in the handle head. The cover is able to be fastened on the head region and, at the same time, the locking module can also be fastened on the handle head for the fastening of a hand strap by means of the second, substantially horizontally arranged cross pin. In this case, the second cross pin preferably penetrates the handle head transversely relative to the pole longitudinal axis and transversely relative to the running direction, as well as the two legs of the cover. The locking module preferably comprises a latching block which is mounted so as to be displaceable and/or rotatable, on or in which latching means are arranged.

In the case of a particularly preferred embodiment, the locking module additionally comprises an actuating element which is fastened on the latching block and can be tilted from the outside against spring force thereby releasing the self-locking.

The actuating element or the release button thereof is developed at least partially so as to form a contour with its top surface preferably on a top surface of the handle head and/or on a hand side directed to the hand-retaining device. In a rest position, the top surface of the actuating element on the top surface of the handle head is integrated at least in part or in particular almost completely in an outside contour of the handle head, and this also remains so during an actuating movement of the actuating element or of the release button. The outside contour of the handle head, in this case, extends in a substantially semicircular or arcuate manner from a tip of the handle head up to a hand-side boundary between the handle head and the handle body.

It is particularly advantageous when the locking module has an axial spiral spring which is arranged in a cavity of the handle body, is pretensioned downward for emergency release and the tension of which is able to be adjusted preferably by means of an adjusting nut.

The latching means are preferably realized in such a manner that in the case of stress that exceeds a normal usage force in the direction of the opening of the hook-shaped device, an emergency release of the strap-shaped, ring-shaped or eye-shaped device is effected.

The latching means are preferably realized in the form of a retaining lug, which in a preferred manner has a beveled flank in the insertion direction upward, and which, in a position tensioned against the hook-like device, defines downward a latching region for the strap-shaped, ring-shaped or eye-shaped device which is restricted against a force, which in a preferred manner is adjustable. According to a particularly preferred embodiment, the retaining lug is preferably connected in one piece to a spring-loaded latching pin, or forms part thereof.

The retaining lug, in this case, is preferably mounted so as to be displaceable, wherein displacement, thereby releasing the restricted latching region against a defined and in a preferred manner adjustable force, is made possible upward, and wherein in a preferred manner the force is ensured by means of a spring or a resilient element. The retaining lug is preferably tensioned with a spiral spring or, as an alternative to this, with an elastomer spring or torsion spring to a displacement position closing the latching region, wherein said tensioning is preferably adjustable such that a safety release is only effected at a force of more than 50-250 N. Said design consequently includes the advantage of an adjustable emergency release for the entire locking module. The release force can be adjusted in a very simple manner by, for example, the locking module being removed from the handle head, and the adjusting nut being adjusted corresponding to the requirements using a corresponding tool. As a result of using a spiral spring, said safety release is also ensured even under the most varied temperature conditions, and, in addition, the spiral spring is well concealed in such a manner in the interior of the pole handle that contamination, icing up or the like can be excluded.

According to a further preferred embodiment, the locking module comprises a fixing element on which the hook-like device is arranged, as well as a latching block on which the latching means are arranged and which is mounted in the handle body downward in the direction of the longitudinal axis of the pole handle by means of an anchoring element. Said locking module preferably additionally comprises a rotatable and/or tiltable actuating element which is realized for releasing the self-locking, wherein the latching block and the actuating element are engaged around by the fixing element and/or are received at least in part in the fixing element.

A particularly advantageous embodiment of the present invention includes a pole handle having a hand-retaining device, or a pole, in particular a ski pole, a Nordic walking pole, a cross-country pole or a hiking pole, having a pole handle according to, and a hand-retaining device is fastened or is fastenable on the pole handle.

A substantial advantage of said modular design is the simplified mounting of the locking module which is produced as an entire unit. As a result of the modular design of the locking module, the locking module is producible as an individual assembly and can be inserted into a handle head or handle body. In addition, as a result of the locking module being received in the recess of the handle head, the retaining mandrel or the hook-shaped device is embedded in an optimum manner in the outside contour of the pole handle, and is not felt to be obtrusive.

Further exemplary embodiments are described in the dependent claims.

BRIEF DESCRIPTION OF THE DRAWINGS

Preferred embodiments of the invention are described below by way of the drawings which serve purely for explanation and are not to be seen as restricting, in which.

DESCRIPTION OF PREFERRED EMBODIMENTS

FIGS. 1*a*.) and 1*b*.) show a schematic representation of a pole handle according to a first exemplary embodiment of the invention.

Figure 1:
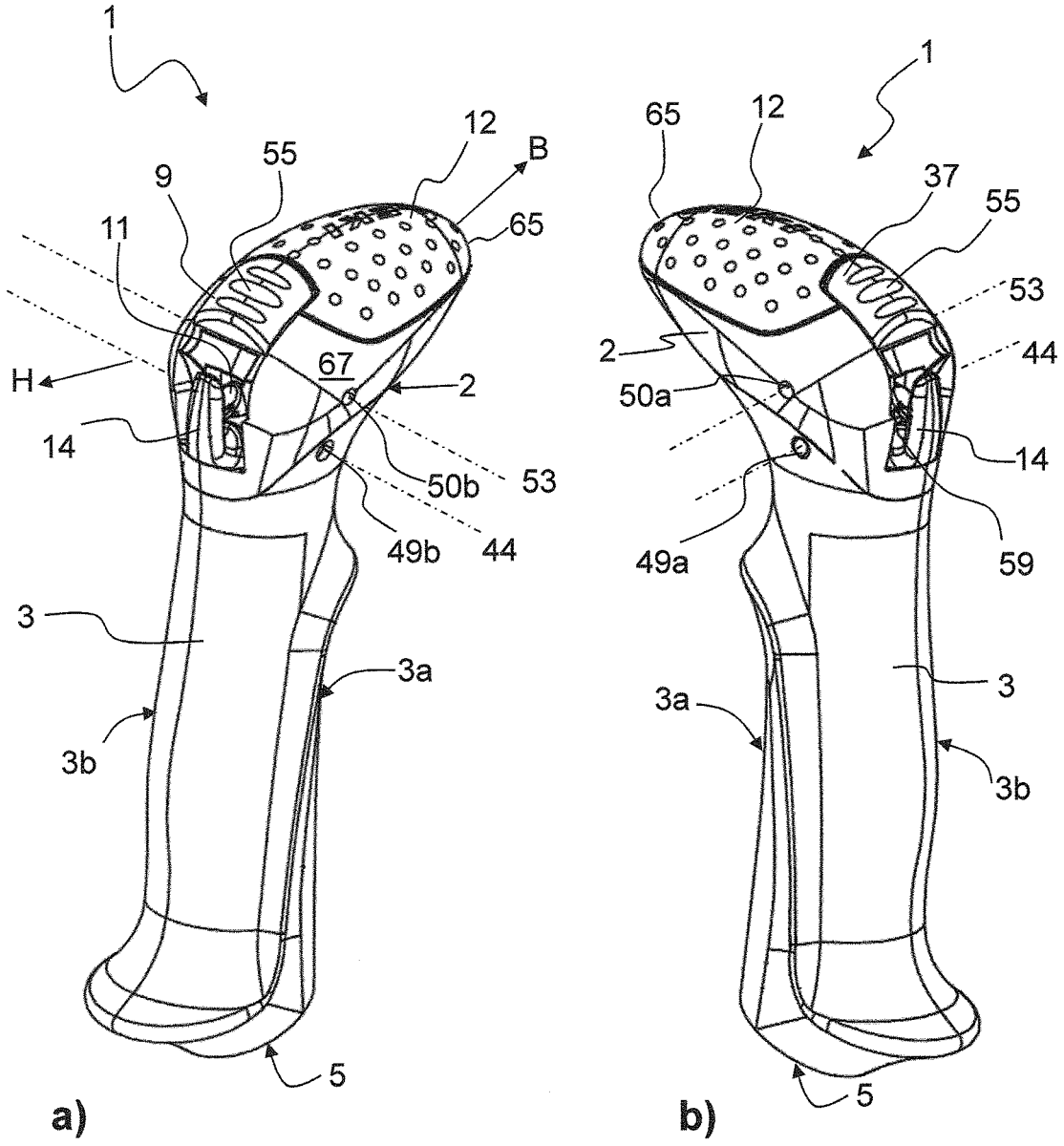
FIG. 1 shows two perspective views of a schematic representation of a pole handle according to the invention.

The pole handle 1 shown comprises a longitudinal axis 56, a handle body 3 with a front pole handle region 3*a* pointing in a running direction or movement direction B and a rear pole handle region 3*b* which is aligned in the opposite direction to the running direction. The pole handle 1 or the handle body 3 thereof has, from below, a central recess or a cavity 5, which is arranged along the or substantially parallel to the pole handle longitudinal axis 56 (not shown in the figure) and into which the pole, which is formed, for example, from an aluminum or carbon or glass-fiber tube, can be inserted and fastened therein. The pole handle shown in FIG. 1 is shown without a pole tube inserted therein from below.

Figure 3:
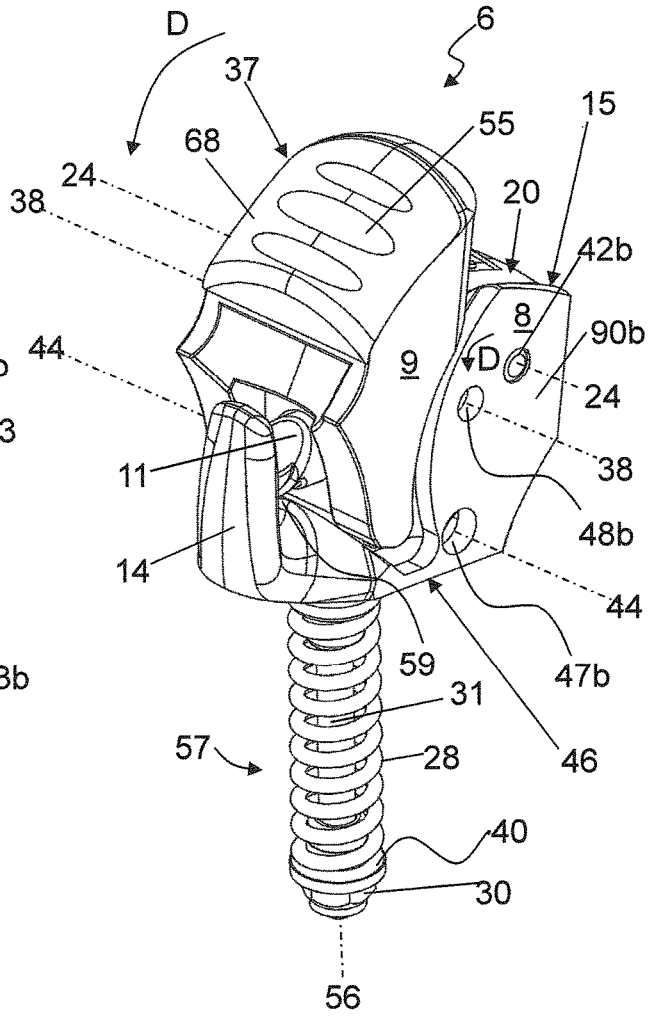
FIG. 3 shows a schematic view of a locking module according to a preferred embodiment.

The pole handle 1 additionally comprises an arched handle head 2 which connects to the top of the handle body 3. The handle head 2 comprises a handle nose with a tip 65 or is formed in part by a handle nose which merges substantially in a shoulderless manner into the top region of the handle body in the front pole handle region 3*a*. The handle lug in the front pole handle region 3*a* is realized in a protrusion projecting beyond the handle body region in the running direction B. The handle head 2 has a recess 4, which is open upward and toward the user hand or toward the hand side H and in which a locking module 6 is arranged. The locking module 6 is shown in detail in FIG. 3, and the individual parts thereof in FIG. 4. The entire locking module 6 is held in the pole handle 1 in the upwardly open recess 4. The locking module 6 according to the preferred exemplary embodiment shown has substantially four main elements: a latching block 20 with an anchoring element 57, an actuating element 9 and a fixing element 15.

Figure 4:
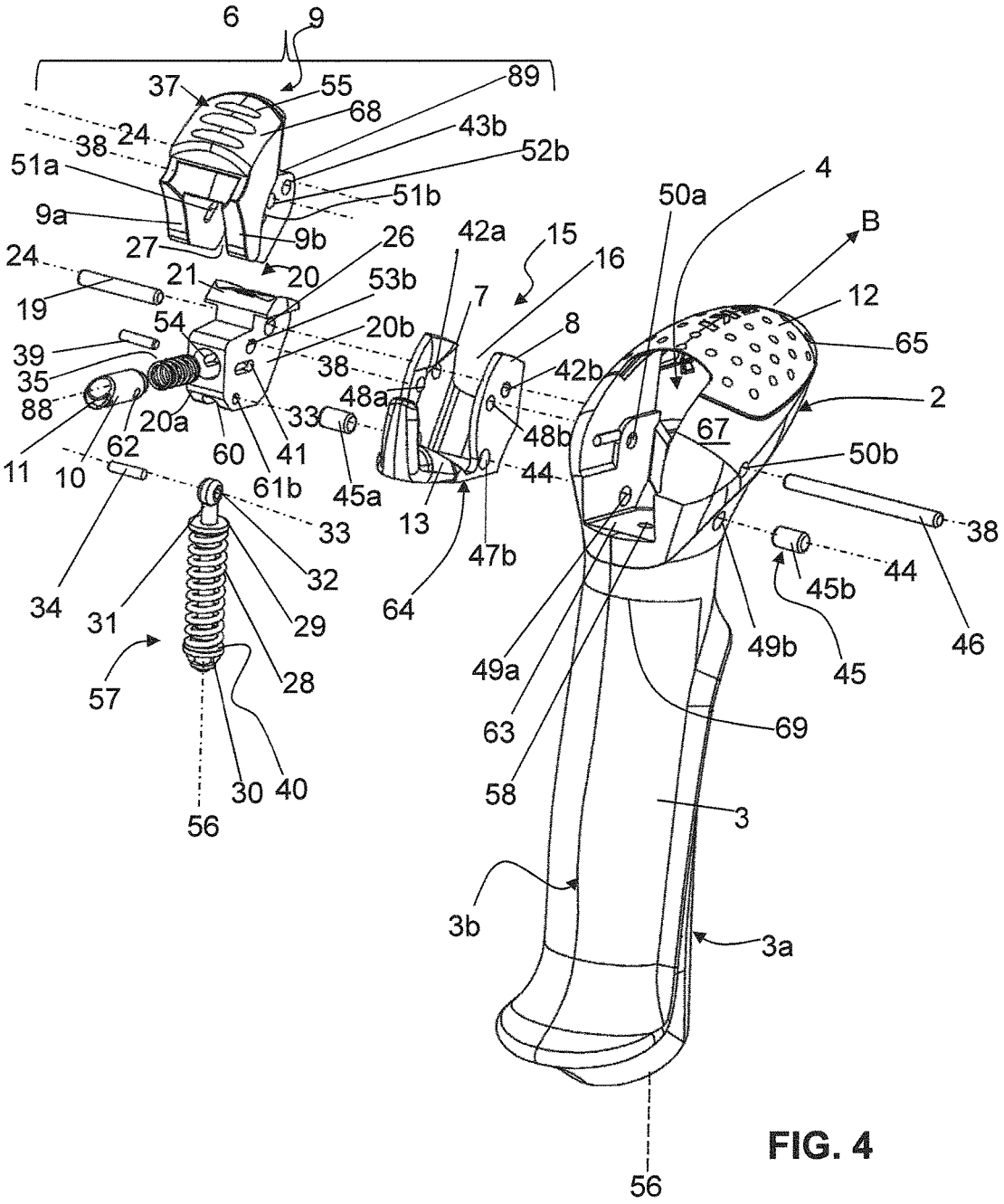
FIG. 4 shows an exploded drawing of a pole handle with a locking module according to a preferred embodiment.

It can be seen in FIG. 4 that a support surface 63, which has a bore 58 into which the locking module 6 is inserted, is arranged in the transition region from the handle head 2 to the handle body 3. The locking module is consequently held in the handle body 3 by means of the anchoring element 57. The bore can be realized as a through-bore 58 which connects the cavity or the recess 4 of the handle head 2 to the above-described cavity in the handle body 3, which is suitable for receiving a pole tube from below.

In the preferred exemplary embodiment shown, the latching block 20, the anchoring element 57 and the actuating element 9 are all held by the fixing element 15. The fixing element 15 is realized in regions in a shell-shaped manner. It comprises a first leg 7 and a second leg 8 which form a shell-shaped region, as well as a web 13 which connects the legs 7, 8 of the fixing element 15 to a hook-shaped device 14 that is realized as a retaining mandrel. In this case, the two legs 7, 8 enclose the two side walls 20*a*, 20*b* of the latching block 20. The retaining mandrel 14 in said exemplary embodiment is connected in one piece to the shell-shaped region of the fixing element 15. The bottom surface of the fixing element 15 forms a bottom 64 which serves for supporting the fixing element 15 or the entire locking module 6 on the support surface 63 in the transition region between the handle head 2 and the handle body 3.

A retaining pin 31, which projects through the bore 58 into the cavity of the handle body 3, is attached on the locking module 6 over an axis 56. The retaining pin 31 has an eye 32 on the top side for the rotatable fastening on the locking module 6 with the axis 33. For fastening the anchoring element 57 on the latching block 20, the anchoring element 57 with its eye 32 is introduced from below into a recess 60 of the latching block 20 which is flanked by two small legs in the bottom region of the latching block 20. Said legs comprise one through-bore 61*b* each which is suitable to receive a pin 34 along an axis 33, the pin 34, for the purposes of fastening the anchoring element 57, penetrating the respective bore 61 of the legs of the latching block 20, and in between the eye 32 of the anchoring element 57.

On its bottom end, the retaining pin 31 is provided with a thread. The retaining pin 31, or rather the entire locking module 6 fastened thereon by means of the latching block 20, is tensioned downward with the aid of a stop element 29, which abuts against the top cover of the cavity or against the bottom surface of the support surface 63, with a spiral spring 28 by means of an adjusting nut 30, which is screwed onto the thread of the retaining pin 31 from below. At one end the spiral spring 28 rests from below on the top stop element 29 on a correspondingly provided shoulder, and at the other end from above on the bottom stop element 40.

A latching pin 10, which serves for the automatic latching of the coupling element 79, for example in the form of a strap-shaped/ring-shaped or eye-shaped device, is arranged in the locking module 6, or in the latching block 20 forming part of the locking module 6. The latching pin 10 is arranged substantially horizontally with respect to the longitudinal axis 56. It is mounted in the locking module 6 in a recess or bore 54 specifically provided for this purpose so as to be displaceable along an axis 88, the latching pin 10 being tensioned against the retaining mandrel 14 by means of a spiral spring 35. The latching pin 10 has a retaining lug 11 which, in a preferred manner, is beveled from above and is realized substantially horizontally at the bottom such that, for example, a strap-shaped/ring-shaped or eye-shaped device 79 inserted from above, displaces the latching pin 10 rearward against the spring tension of the spiral spring 35 and the strap-shaped/ring-shaped or eye-shaped device 79 is captive under the latching pin 10 in the latching region 59. The latching pin 10 comprises a (through-)bore 62 which extends horizontally with respect to the pin axis 88 and through which a cross pin/guide pin 39 is inserted in order to guide the latching pin 10 inside an elongate hole 41 in the interior of the latching block 20.

The locking module 6 has an actuating element 9 with a release button 37 on the top surface 68. In the present exemplary embodiment, said release button 37 is connected in one piece to the actuating element 9 or to the wings 9*a*, 9*b* thereof. The latching block 20, or the side walls 20*a*, 20*b* thereof, are surrounded from above and behind, i.e. when viewed from the retaining mandrel 14, by the two wings 9*a*, 9*b* of the actuating element 9. The portion of the latching block 20 which is directed rearward (toward the retaining mandrel 14 or toward the hand) and comprises the recess 54 for the latching pin 10 is inserted, in this case, from below into a recess 27 of the actuating element 9. The recess 27 is realized as a result of the realization of the wings 9*a*, 9*b* of the actuating element 9 in the manner of an inverted U-shape. The latching block 20 additionally comprises a top shoulder 21, the width of which is greater than the length of the through-bore 26, measured in a direction horizontally to the longitudinal axis 56. Said shoulder 21 rests on the top of a back 89 of the actuating element 9. The great advantage of said design is that the projections or wings 9*a*, 9*b* of the actuating element 9 are positioned in an ideal manner for the actuation of the desired release, however an unwanted release is nevertheless able to be avoided completely.

If the strap-shaped/ring-shaped or eye-shaped device 79 pushed over the retaining mandrel 14 is to be released from the latching region 59 under normal conditions, a release button 37 is provided for this purpose on the top surface 68 in the locking module 6 or on the actuating element 9. A rotational axis 38 is arranged horizontally and transversely with respect to the direction of the latching pin 10 in the locking module 6. The actuating element 9 forming the release button 37 is mounted inside the locking module 6 so as to be tiltable about said rotational axis 38 (anti-clockwise in FIGS. 1*a* and 3, clockwise in FIGS. 7 and 8). In addition, a guide pin 39 is also arranged transversely to the latching pin 10 and horizontally in a bore 62 of the latching pin 10. Said guide pin 39 is also mounted in the actuating element 9. To this end, the wings 9*a*, 9*b* of the actuating element 9 comprise one elongate hole 51*a*, 51*b* each, in which the guide pin 39 engages.

With the actuating element 9 in a rest position, the guide pin 39 rests at the bottommost end of the respective elongate hole 51*a*, 51*b*, and during the rotational movement D of the actuating element 9 in the running direction B is pushed upward at an angle. The respective elongate hole 51*a*, 51*b* comprises to this end a direction of movement which is arranged angled downward in relation to that of the elongate hole 41 in the latching block 20. Thus, the rotational movement D of the actuating element 9 is converted into a displacement movement of the latching pin 10 along the axis 88 substantially in the running direction B: If the release button 37, which in the present exemplary embodiment is realized in one piece with the lateral projections or wings 9*a*, 9*b*, is pressed downward, for example by the thumb of the hand gripping the pole, the actuating element 9 tilts slightly downward as one unit and as a result, when rotating about the rotational axis 38 (in arrow direction D in FIG. 3), pushes the latching pin 10 inward by means of the guide pin 39 against the spring force of the spiral spring 35, consequently releasing the latching region 59 upward and as a result also a strap-shaped/ring-shaped or eye-shaped device or a coupling element 79 which is captive therein.

The latching block 20 is consequently held in the actuating element 9 by two pins: on the one side by the axial pin 19 which is arranged along the rotational axis 24 of the locking module 6 and also at the same time connects the latching block 20 and the actuating element 9 to the respective leg 7, 8 of the fixing element 15, and secondly by the guide pin 39 which, when viewed from inside to outside, connects the latching pin 10 to the latching block 20 and then to the actuating element 9.

On a top region, the latching block 20 comprises a through-bore 26 which is arranged horizontally with respect to the longitudinal axis 56 of the pole handle 2 and is suitable to receive an axial pin 19 along a rotational axis 24. The axial pin 19, in this case,—when viewed from inside to outside-first of all penetrates said bore 26 in the latching block 20, then two bores 43*a*, 43*b* in the respective wings 9*a*, 9*b* of the actuating element 9, as well as the respective bore 42*a*, 42*b* of the respective above-described legs 7, 8 of the fixing element or of the fixing shell 15. As a result, the actuating element 9 rotates about the rotational axis 38 on the latching block 20. During the rotational movement of the actuating element 9, only the actuating element 9 and the latching pin 10, and the spiral spring 35 thereof, move in the locking module 6, not, however, the latching block 20 itself or the fixing element 15. When the locking module 6 is inserted in the handle head 2, the through-bore 26 in the latching block 20, the bores 43*b* in the fastening element 9, the bores 42*a*, 42*b* in the fixing element 15 extend coaxially to one another along the axis 24, along with the axial pin 19 which is inserted therein and connects the fastening element 9, the latching block 20 and the fixing element 15 to the handle head 2.

Figure 7:
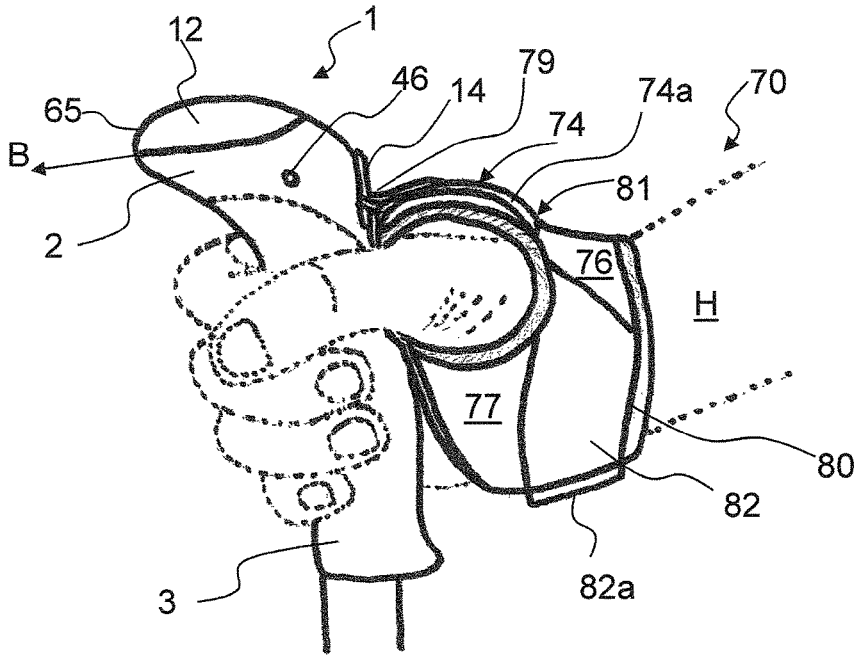
FIG. 7 shows a schematic representation of a user hand engaging around a pole handle having a hand strap according to FIG. 5, coupled to the pole handle.
Figure 8:
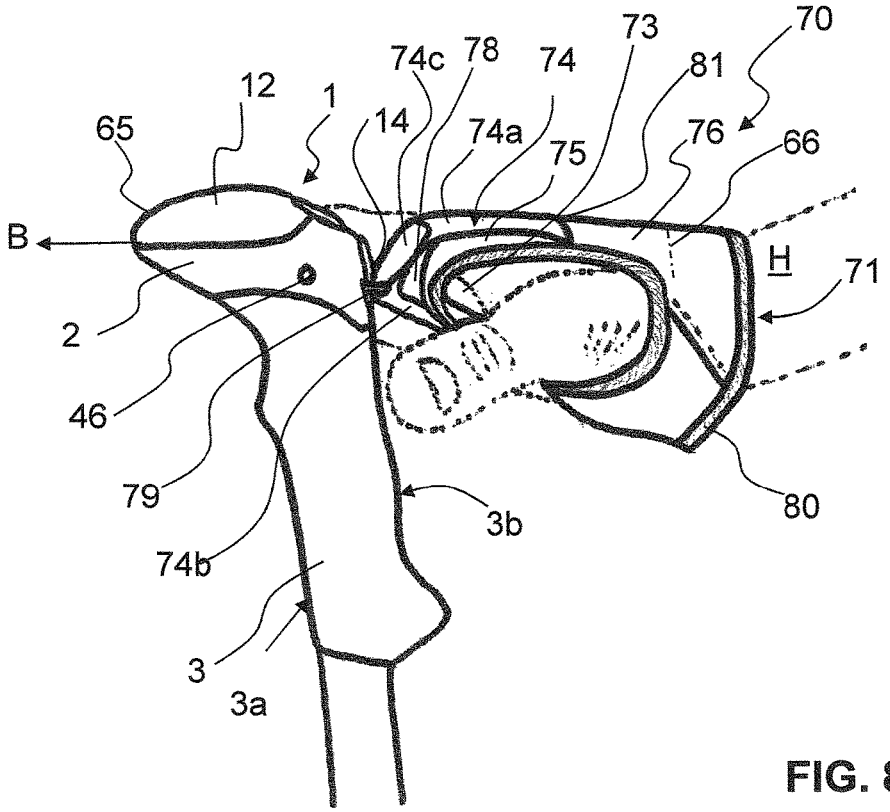
FIG. 8 shows a schematic representation of a user hand with a hand strap according to FIG. 5 coupled on a pole handle, wherein the user hand is either introducing or releasing the engaging-around position of the pole handle.

By inserting the locking module 6 into the recess 4 of the handle head 2, the retaining mandrel 14 is embedded optimally in the outside contour of the pole handle 1. Nevertheless, there is still an ideal insertion opening from above for an eye/strap 79, as shown in FIGS. 7 and 8. The contour of the actuating element 9 is also adapted to the overall curvature of the handle head 2 in the rest state and during the rotating/tilting movement about the rotational axis 38. The actuating element 9 is developed at least in part so as form the contour on a top surface 67 of the handle head 2 and on the hand side H that is directed to the hand-retaining device 70, a top surface 68 of the actuating element 9 on the top surface 67 of the handle head 2 being almost completely integrated in an outside contour of the handle head 2 in a rest position and also during an actuating movement of the actuating element 9. The outside contour of the handle head 2, in this case, extends in a substantially arcuate manner from a tip 65 of the handle head 2 up to a boundary 69 on the hand side between the handle head 2 and the handle body 3.

In addition, the locking module 6 is fastened on the handle head 2 along an axis 44 transversely with respect to the longitudinal axis 56 of the pole handle 1 by means of a further cross/fastening pin 45. Said pin engages from outside through a bore 49*a* or 49*b* on the outside of the handle head into the recess 4, and then through the bore 47*a* or 47*b* in the legs 7 or 8 of the fixing element 15. In the present exemplary embodiment in FIG. 4, the cross pin 45 is shown in two parts with two pin parts 45*a*, 45*b*. As an alternative to this, said cross pin 45 can also be realized in one piece and extend from the one outside surface of the handle head through the legs 7, 8 of the fixing element 15, through the recess 4 up to the other outside surface of the handle head again. In said case, the cross pin 45 extends in the shell-shaped region of the fixing element 15 below the bottom surface of the latching block 20 which is inserted into the fixing element, or in a recess of the latching block 20. When the locking module 6 is inserted in the handle head 2, the bores 49*a*, 49*b* in the handle head 2, as well as the bores 47*a*, 47*b* in the fixing. element 15 extend coaxially to one another, along the axis 44, along with the cross pin 45 which is inserted therein and connects the fixing element 15 to the handle head 2.

The advantage of the arrangement of said further cross pin 45 is that the torsion forces which are brought about by the tilting of the actuating element 9 about the rotational axis 38 and at all events—in particular in the event of a fall—also by the rotating of the entire locking module 6 about the rotational axis 24, are better absorbed.

Figure 2:
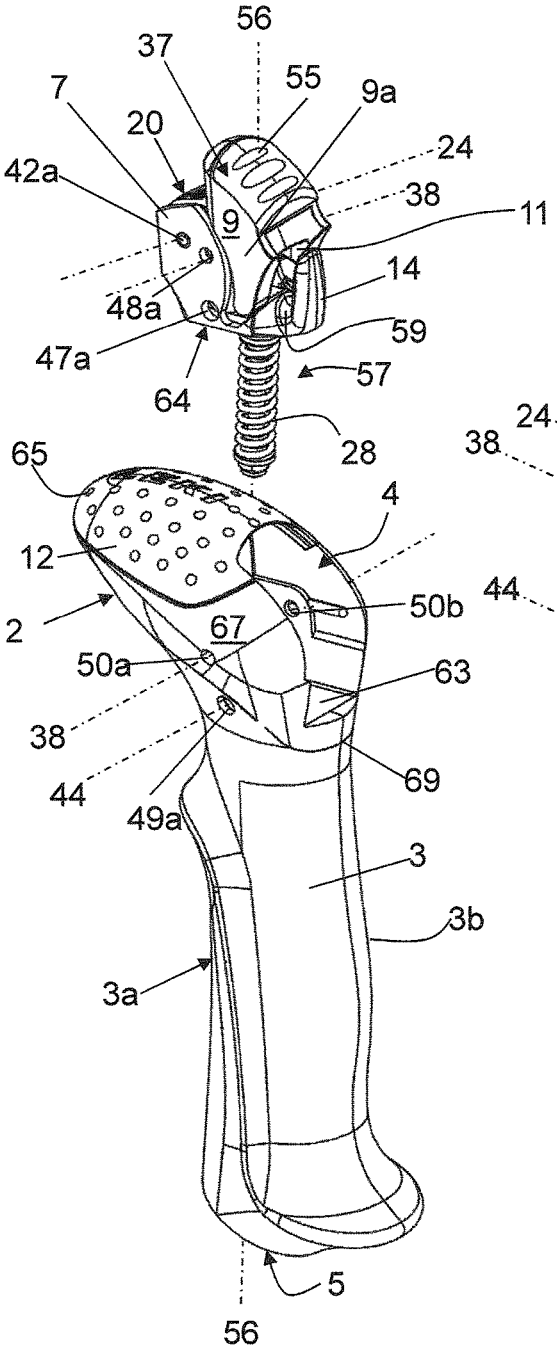
FIG. 2 shows a perspective view of the schematic representation of FIG. 1*a*, the locking module having been removed from the handle head.

The pole handle 1 according to the exemplary embodiment shown in FIGS. 1, 2 and 4 additionally comprises a cover 12 which can be fastened on the handle head 2 as a separate component. The contour of the cover 12 in its region tapering toward the tip 65 corresponds substantially to the contour of the handle head 2 in its portion facing the pole handle front side 3*a*. Two legs (not shown), which are integrally molded on the cover 12 by means of a web each, are arranged in the rear region of the cover 12. In the state fitted on the handle head 2, the legs project into the handle head 2, parallel to the pole handle longitudinal axis 56, into the recess 4 of the handle head 2, or between an inner wall which delimits the recess inward and an outer wall of the handle head 2. Each leg comprises a recess, through which the fastening pin 46 is insertable along an axis 38 transversely with respect to the longitudinal axis 56 of the pole handle 1, said pin fastening the cover 6 on the handle head 2 and serving at the same time for the fastening of the locking module 6. When the locking module 6 is inserted in the handle head 2, the bores 50*a*, 50*b* in the handle head 2, the bores 48*a*, 48*b* in the fixing element 15, the bore 53 in the latching block 20 and the bores 52*b* in the fastening element 9 extend coaxially to one another, along the axis 38, along with the fastening pin 46 which is inserted therein and connects the fastening element 9, the latching block 20 and the fixing element 15 to the handle head 2.

In the exemplary embodiment shown, a latching lug (not shown), which, in the fitted state, projects from the front handle head edge into the hollow region of the cover 6 and there latches into a recess or an undercut on the inside surface of the cover 6, is arranged in the front tapering region of the handle head 2. In the exemplary embodiment shown, the inside surface of the cover 6 comprises several struts (not shown). A cutout 25 for the release button 37 of the actuating element 9 is arranged in the rear portion of the cover 6 which, in the mounted state, faces the rear pole handle region 3*b*, i.e. points in a direction H opposite to the running direction B.

For mounting the locking module 6, which is produced as an entire unit, it can be inserted from above into the recess 4 in the pole handle 1, the anchoring element 57 provided on the locking module 6 being inserted into the through-bore 58 between the recess 4 and the cavity 5 for the pole tube in the handle body 3. On the retaining pin 31, the anchoring element comprises a top stop element 29, as well as a spiral spring 28 which is pushed over the retaining pin 31, and a bottom stop element 40, which is screwed from below onto the thread of the retaining pin 31, and an adjusting nut 30. The downward spring-elastic retaining force, which is exerted onto the locking module 6 by means of the spiral spring 28, can be adjusted by the adjusting nut 30 being screwed upward more or less. Finally, a fastening pin 46 can be pushed in laterally through the bores 50*b*, 50*c* in the handle head 2 along an axis 38.

When viewed from outside to inside (from both sides of the handle head), the fastening pin 46 penetrates the bores

50*a* or 50*b* in the handle body 2, as well as the bores 48*a* or 48*b* of the legs 7 or 8 of the fixing element 15, then the two bores 52*b* of the wings 9*a*, 9*b* of the actuating element 9, and then the bore 53 of the latching block 20.

Between the bores 50*a*, 50*b* in the handle head 2 and the bores 48*a*, 48*b* in the fixing element 15, the fastening pin 46 additionally penetrates, according to a particularly preferred exemplary embodiment, on each side of the handle head, a bore/recess of a leg of a cover 12 (the legs not being visible in FIG. 4 as they extend along the longitudinal axis 56 of the pole handle 1 between an inside wall of the handle head 2, which delimits the recess 4 inwardly, and an outside wall of the handle head 2).

The fastening pin 46 consequently serves at the same time for fastening the locking module 6 in the handle head 2 and fastening the cover 12.

The adjustable emergency release of the entire locking module 6 produced by said design functions as follows: If an excessive force (for example in the case of a fall) is exerted from below namely onto the retaining lug 11 by a strap-shaped/ring-shaped or eye-shaped device 79, the entire locking module 6 is rotated about the rotational axis 24, (in the representation of FIG. 1*a*.) or FIG. 3 clockwise, in FIGS. 7, 8 anticlockwise). This continues until the latching region 59 is released or until the coupling element in the form of a strap-shaped/ring-shaped or eye-shaped device 79 is released from the retaining mandrel 14.

Figure 5:
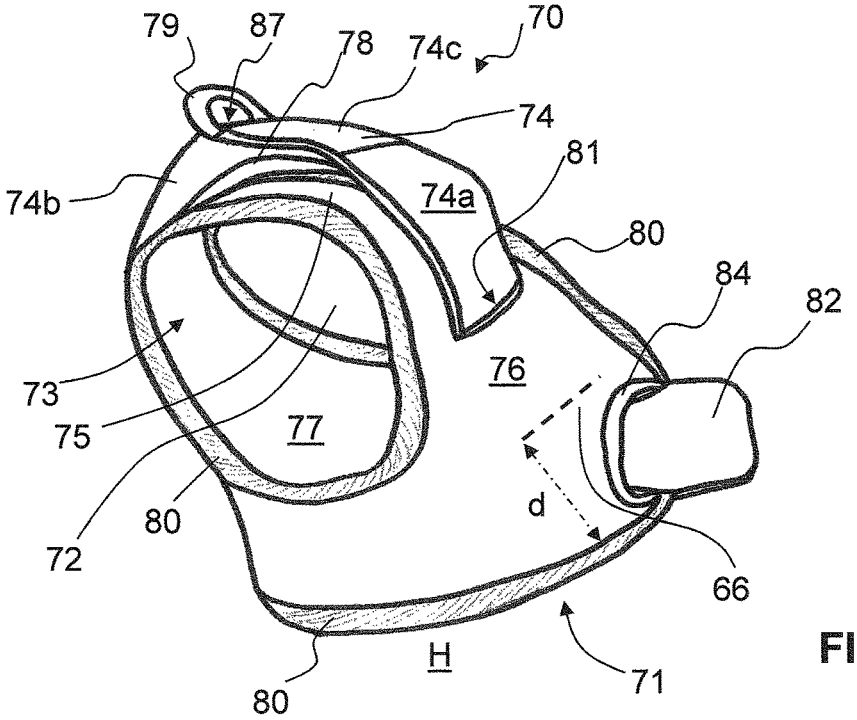
FIG. 5 shows a perspective view of a schematic representation of a hand-retaining device according to a preferred embodiment of the invention.
Figure 6:
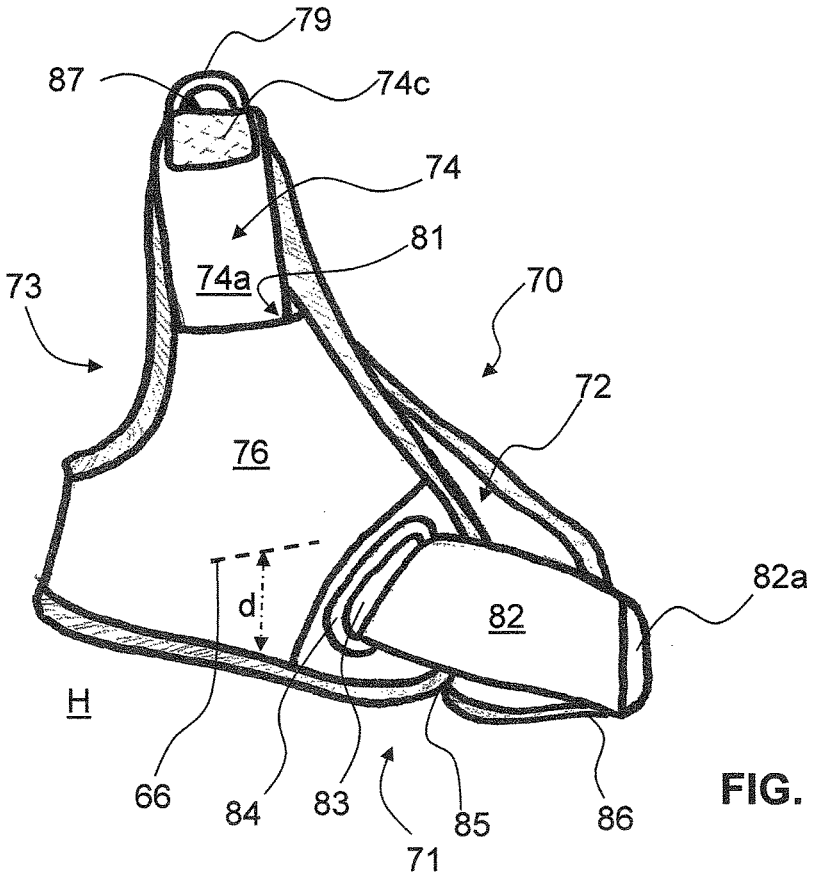
FIG. 6 shows a top view of a schematic representation of the hand-retaining device of FIG. 5.

FIGS. 5 and 6 show a hand-retaining device 70 in the form of a hand strap which can be fastened for fastening on a pole handle 1 according to FIGS. 1- 4, as described above. The hand-retaining device 70 should be fastened in such a manner on the hand-retaining device that the forces occurring when the pole is in use are distributed well onto the hand. To this end, it requires a hand strap which is not only placed loosely around the hand or the wrist but which is fixedly connected to the hand. In this case, it is possible to consider as the hand-retaining device 70 a hand strap which is worn by over a glove or over the bare hands and which has a strap-shaped/ring-shaped or eye-shaped device 79.

The hand strap 70 according to the exemplary embodiment shown comprises an insertion opening 71 for the hand, a first exit opening 72 for the back of the hand and a second exit opening 73 for the thumb.

The hand strap 70 is fastened on a pole handle 1 of the pole at least indirectly by means of a first strip 74 which is guided between the thumb and the other fingers.

The head region of the pole handle 1 shown in FIGS. 7 and 8 is formed such that it comprises a retaining mandrel 14 which, by means of a slot in the handle body 2 or, in the event of the pole handle according to the invention according to FIGS. 1-4, by forming a latching region 59, forms part of the locking module 6 of the pole handle 1. A strap-shaped/ring-shaped or eye-shaped device 79 of the hand strap 70 which is inserted into said latching region 59 is able to be fixed in a self-locking manner on the retaining mandrel 14 in the latching region 59 and can be removed again out of the latching region 59 by actuating the release button 37.

The actual hand-retaining device 70, which is realized as a hand strap 70 in the present exemplary embodiment in FIGS. 5-9, can be fixed and fastened on the hand of the user. To this end, the hand strap has three openings, namely an insertion opening 71 in the hand strap for inserting the hand, a first exit opening 72 for the back of the hand and a second thumb opening 73 which, as a rule, is developed as the smallest exit opening. In FIG. 5, the second exit opening 73 of the hand strap for the thumb faces the observer and the first exit opening 72 for the back of the hand is remote from the observer. The hand strap shown is consequently a hand strap for the right hand. The hand strap therefore has a strip-like region which is composed of the region 76 on the side of the exterior surface of the hand which is arranged on the back of the hand between the thumb and the fingers, which merges in one piece into the strip 75 between the thumb and the fingers, and which then merges into the region 77 on the side of the interior surface of the hand which comes to rest on the inside surface of the hand. Said regions 75, 76 and 77 are provided in a preferred manner on their inside surface with a textile or elastomer foam material insert, i.e. a textile layer is either sewn or bonded with the actual carrier material which, in the majority of cases, is non-elastic and, for example, can consist of a woven plastics material.

Said strip then has at least one variable connecting region. The variable region is the region between the opening 72 for the back of the hand and the insertion opening 71 for the hand. In said region, a first Velcro strip 82 is provided for adjusting and fastening the hand strap on the hand. In the present exemplary embodiment, said Velcro strip is a webbing on the outside surface of which two complementary Velcro regions are mounted, a first Velcro region in the end region and a second Velcro region of complementary type in the region in which said first Velcro strip 82 is sewn to the hand strap. The free end of the fastening strip 82 is guided through a feed-through stirrup 84. The loose end of said fastening strip 82 in the non-fastened state typically has a retaining aid 82*a* which can be realized, for example, by a hemmed turnover of the webbing. Said retaining aid also serves for the purpose of preventing to a large extent the fastening strip 82 from unintentionally sliding through the feed-through stirrup 84. The fastening strip 82 can be placed around said feed-through stirrup 84 for fastening the hand strap on the hand, the first Velcro region coming to rest on the second Velcro region and it thus being possible to adjust in a fixed lasting manner the distance between the regions 85 and 86 (two ends of the hand strap), in dependence on the size of the hand and in dependence on whether the user wears gloves or not.

In the hand-retaining device according to the invention, a coupling device 79, which is realized as a strap-shaped/ring-shaped or eye-shaped device, is fastened on a first strip 74 for fastening the hand-retaining device on a pole handle. Said first strip 74 overlaps a second strip 75 which, as mentioned above, is guided between the thumb and the fingers and, in the present exemplary embodiment, is connected in one piece to the region 76 on the side of the exterior surface of the hand and to the region 77 on the side of the interior surface of the hand of the hand-retaining device 70. Said first strip 74 is realized in part in an elastic manner. In the exemplary embodiment shown in FIG. 5, said first strip 74 is developed in portions as an elastic band, in the regions 74*a*, 74*c* between the coupling device 79 and the fastening 66 of the first strip 74 on the region 76 of the hand-retaining device 70 on the side of the exterior surface of the hand. In this case, the elastic band is reinforced by a webbing portion in the region 74*c* which is closest to the coupling element 79 on the side of the exterior surface of the hand. The first strip is realized as webbing in the region 77 of the hand strap 70 on the side of the interior surface of the hand. It is sewn onto the hand-retaining device in the region 77 on the side of the interior surface of the hand and then extends in the region in which the first strip 74 overlaps the second strip 75 which is guided between the thumb and the fingers, spaced from the second strip 75 as far as up to the coupling element 79 and beyond until it overlaps the elastic band. There it is then sewn on the elastic band in an overlapping region or reinforcement region 74*c*. The webbing, in the present exemplary embodiment, is even doubled such that in the region of the coupling element 79 a webbing portion extends through the strap-shaped/ring-shaped or eye-shaped device 79 and overlaps the elastic band on its top surface, whilst a second webbing portion is sewn in the region 77 on the side of the interior surface of the hand at the bottom on the first webbing portion, and extends in the region of the coupling element 79 through below the strap-shaped/ring-shaped or eye-shaped device 79 and overlaps the elastic band on its bottom side. In the present exemplary embodiment, the reinforced region of the first strip 74 is consequently realized with three layers, the elastic band coming to rest between two webbing portions and the three layers being sewn together. The strap-shaped/ring-shaped or eye-shaped device 79 is held between two webbing layers and in the present example is sewn, the strap-shaped/ring-shaped or eye-shaped device 79 comprising a certain inherent rigidity and thus standing out from the first strip 74. In the region on the side of the exterior surface of the hand, the first strip 74 extends separately or at a distance from the second strip 75 thereby forming a space 78. In a transition region in which the second strip 75 merges in one piece into the region 76 on the side of the exterior surface of the hand, said region 76 on the side of the exterior surface of the hand is realized with multiple layers, the top layer being formed from a plastics material, preferably from a plastics material mesh or plastics material woven fabric. In said transition region, said top layer, or surface layer of the hand strap comprises a slot 81 or an insertion opening, through which the first strip 74, which is realized as an elastic band in said region, is able to enter and extends up to its end on the side of the exterior surface of the hand (not visible in the figure) between the two material layers of the hand-retaining device 70. The fastening 66 of the end of the first strip 74 on the side of the exterior surface of the hand is then preferably effected as a result of sewing. The elastic region 74*a* of the first strip consequently comprises a portion 74*a* which is freely accessible from the outside and a tunneled portion (not visible in FIG. 5) which extends between two material layers of the region 76 of the hand-retaining device 70 on the side of the exterior surface of the hand.

In order to keep the length of the elastic region 74*a* of the first strip 74 as long as possible, the fastening 66 of the end of the first strip 74 on the side of the exterior surface of the hand is to be mounted as close as possible to the insertion opening 71 for the hand. As a result, the seam in the event of fastening through sewing is then to be close to the feedthrough stirrup 84. In the present exemplary embodiment, the fastening is arranged at a distance d of approximately between 1.5 and 2.5 cm away from the insertion opening 71 for the hand, measured from the edge of the hand strap 70 at the insertion opening 71 for the hand on the hand side H.

The second strip 75, which connects the region 76 of the hand-retaining device 70 on the side of the exterior surface of the hand to the region 77 on the side of the interior surface of the hand, is realized in a substantially non-elastic manner, or only insofar as the material chosen for the hand-retaining device is elastic per se. At all events, the second strip 75 is realized in a reinforced manner, e.g. by sewing on a webbing strip, preferably on its top surface which is directed toward the first strip.

In the present example, the first strip 74 is only realized in an elastic manner in the region 76 on the side of the exterior surface of the hand, i.e. no further than up to the fastening region 87 where the hand strap 70 is fastened on a pole handle 1, or where the coupling element 79 is arranged. The first strip could, however, also be realized in an elastic manner additionally in the region 77 of the hand-retaining device 70 on the side of the interior surface of the hand.

In the present exemplary embodiment, the hand-retaining device 70 is realized in a reinforced manner by a reinforcing edge 80 at its three openings 71, 72, 73. This increases the wearing comfort and contributes to the dimensional stability of the hand strap such that the hand strap has a certain inherent rigidity even in the non-worn state and does not collapse, which makes inserting the hand easier. In the present exemplary embodiment, the reinforcing edge is consequently a textile or webbing strip which is folded over the edge region of the hand strap at the boundary to the openings and sewn and/or bonded in said regions with the material of the hand strap. As a result, the hand strap abuts as comfortably as possible against the hand. However, the reinforcing edge does not necessarily have to consist of a separate strip material or band material, but can be formed by a seam or a join to a certain extent from the edge region of the material strip forming the hand strap.

Figure 9:
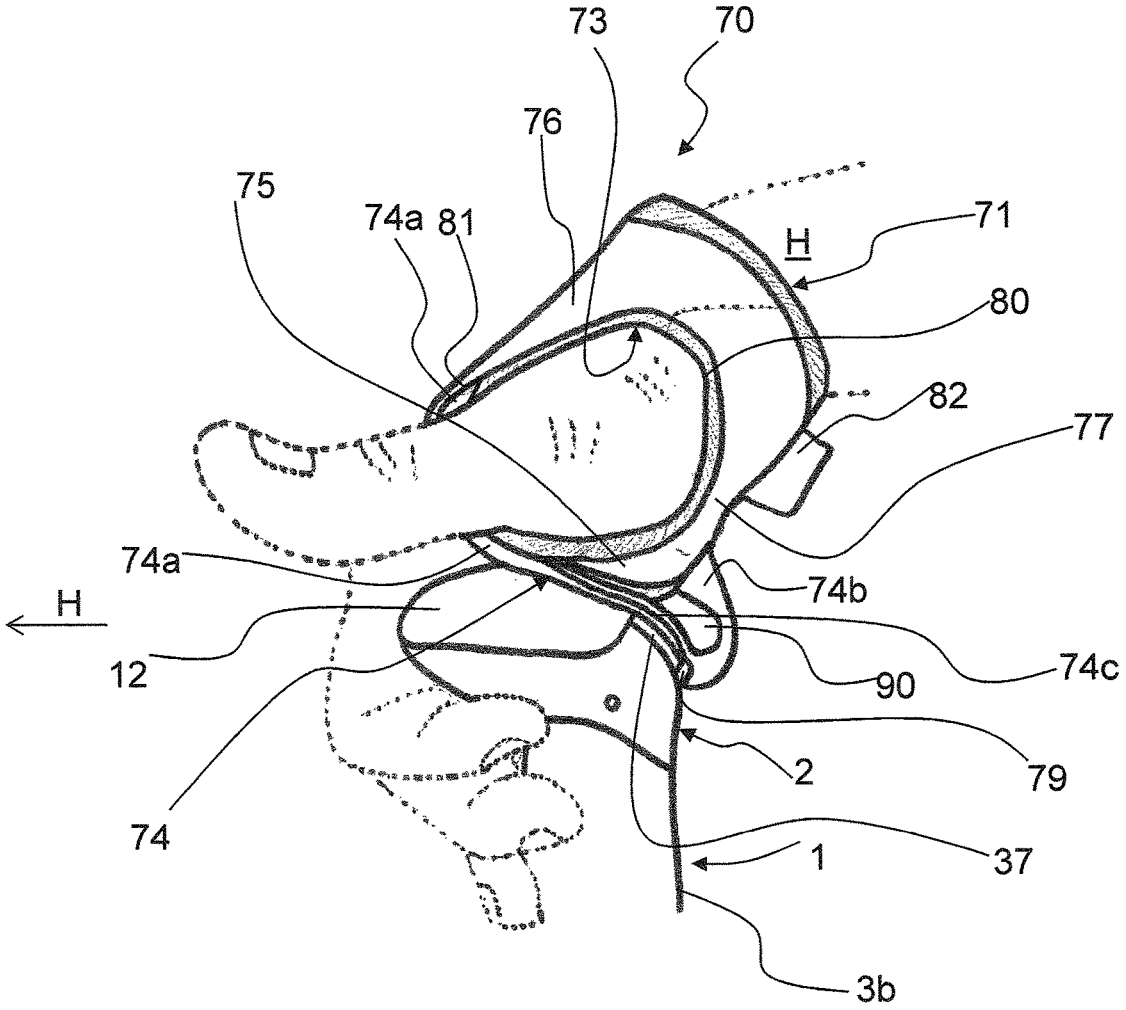
FIG. 9 shows a schematic representation of a user hand with a hand strap according to FIG. 5 coupled on a pole handle, wherein the user hand has assumed the top engaging-around position of the pole handle (with the thumb stretched out for the purpose of making the form of the first strip visible).

FIG. 9 shows a pole handle 1 according to the invention and how it is coupled to a hand strap 70 worn on the right hand of a user, the hand of the user being arranged in the engaging-around position or wrap-around position. The thumb of the user hand, in this case, is shown raised simply for the purposes of visualizing the development of the first strip 74. In this case, it can be seen how the first strip 74, which emerges out of the slot 81 on the region 76 of the hand strap 70 on the side of the exterior surface of the hand, stretches, the elastic region 74*a* extending up to the coupling element 79. In this case, the portion 74*c* of the elastic region 74*a*, which is placed close to the coupling element 79, is realized in a reinforced manner, or in the particular case as an elastic band which is oversewn and undersewn by non-elastic webbing. The portion 74*b* of the first strip, which faces the region 77 on the side of the interior surface of the hand, is realized in a non-elastic manner from the coupling element 79 onward, in the particular case with doubled webbing, said webbing being the same that reinforces the elastic band in the vicinity of the coupling element 79. Said non-elastic region, which extends from the coupling element 79 up to the fastening of the first strip 74 on the region 77 of the hand strap 70 on the side of the interior surface of the hand, is opened out in the wrapped-around state shown in FIG. 9 to form a strap as, on account of the stretch of the elastic region 74*a* in the case of a fixed position of the coupling element 79 in the latching region 59 of the pole handle 1, the non-elastic region 74*b* bends away from the hand strap. In this case, a space 90 is produced between the second strip 75 that is guided between the thumb and the remaining fingers and the non-elastic region 74*b* of the first strip 74.

LIST OF REFERENCES

| | |
|---|---|
| 1 | Pole handle |
| 2 | Handle head |
| 3 | Handle body |
| 3a | Front handle body region |
| 3b | Rear handle body region |
| 4 | Recess in 2 |
| 5 | Cavity in 3 for pole tube |
| 6 | Locking module |
| 7 | First leg of 15 |

-continued

LIST OF REFERENCES

| | |
|---|---|
| 8 | Second leg of 15 |
| 9 | Actuating element |
| 9a | First wing of 9 |
| 9b | Second wing of 9 |
| 10 | Latching pin |
| 11 | Retaining lug on 10 |
| 12 | Cover |
| 13 | Web on 15 |
| 14 | Hook-like device, retaining mandrel |
| 15 | Fixing element, fixing shell |
| 16 | Recess 15 |
| 19 | Axial pin in 20 along 24 |
| 20 | Latching block |
| 20b | Second side wall of 20 |
| 21 | Top shoulder of 20 |
| 24 | Rotational axis of 9 |
| 26 | Bore in 20 for 24 |
| 28 | Axial spiral spring |
| 29 | Top stop element |
| 30 | Adjusting element |
| 31 | Retaining pin |
| 32 | Eye of 31 |
| 33 | Axis though 32 |
| 34 | Pin through 32 |
| 35 | Spiral spring for 10 in 54 |
| 37 | Release button |
| 38 | Axis of 46 |
| 39 | Guide pin for 10 |
| 40 | Bottom stop element |
| 41 | Elongate hole in 20 for guiding 10 |
| 42a | Bore in 7 for 19 |
| 42b | Bore in 8 for 19 |
| 43b | Bore in 9 for 19 |
| 44 | Axis for 45 |
| 45 | Cross pin |
| 45a | Pin part 1 of 45 |
| 45b | Pin part 2 of 45 |
| 46 | Fastening pin |
| 47a | Bore in 7 for 45 |
| 47b | Bore in 8 for 45 |
| 48a | Bore in 7 for 46 |
| 48b | Bore in 8 for 46 |
| 49a | First bore in 2 for 45 |
| 49b | Second bore in 2 for 45 |
| 50a | First bore in 2 for 46 |
| 50b | Second bore in 2 for 46 |
| 51a | Elongate hole in 9a for guiding 10 |
| 51b | Elongate hole in 9b for guiding 10 |
| 52b | Bore in 9b for 46 |
| 53 | Bore in 20 for 46 |
| 54 | Bore in 20 for 35 |
| 55 | Rib on 68 |
| 56 | Longitudinal axis of 1 |
| 57 | Anchoring element of 6 in 3 |
| 58 | Through-bore for 31 |
| 59 | Latching region on 14 for 79 |
| 60 | Recess in 20 for 32 |
| 61b | Bore in 20 for 34 |
| 62 | Bore in 10 for 39 |
| 63 | Support surface in 4 for 64 |
| 64 | Bottom of 15 |
| 65 | Tip of 2 |
| 66 | Fastening of 74 on 76/seam |
| 67 | Top surface of 2 |
| 68 | Top surface of 9 |
| 69 | Boundary between 2 and 3 |
| 70 | Hand-retaining device, hand strap |
| 71 | Insertion opening for hand |
| 72 | First exit opening in 70 for back of hand |
| 73 | Second exit opening in 70 for thumb |
| 74 | First strip on 70 |
| 74a | Elastic region of 74 |
| 74b | Non-elastic region of 74 |
| 74c | Reinforced region of 74 |
| 75 | Second strip on 70 |
| 76 | Region of 70 on side of hand exterior surface |
| 77 | Region of 70 on side of hand interior surface |

-continued

LIST OF REFERENCES

| | |
|---|---|
| 78 | Space between 74 and75 |
| 79 | Strap-shaped/ring-shaped/eye-shaped device/coupling element |
| 80 | Reinforcing edge |
| 81 | Slot in 70 for 74 |
| 82 | Variably securable fastening device |
| 82a | Retaining aid on 82 |
| 83 | Through-opening for 82 in 70 |
| 84 | Feedthrough stirrup of 83 |
| 85 | First end of 70 |
| 86 | Second end of 70 |
| 87 | Fastening region of 70 on 1 |
| 88 | Axis of 10 |
| 89 | Rear of 9 |
| 90 | Space between 74b and75 |
| B | In direction of movement or running direction/forward |
| d | Distance from 66 to 71 |
| D | Direction of rotation for releasing the latching effect |
| H | Hand side/directed rearward |

The invention claimed is:

1. A hand-retaining device for fastening on a pole handle, said hand-retaining device comprising:

an insertion opening for the hand, a first exit opening for the back of the hand, and a second exit opening for a thumb, wherein the hand-retaining device also comprises a first strip which is guided between the thumb and other fingers of the hand and on which is provided a coupling element which can be fastened in a releasable mechanism in a self-locking manner in or on the pole handle, wherein the first strip is realized in an elastic manner at least in regions on an exterior hand surface side of the coupling element, wherein the first strip connects a region of the hand-retaining device on a side of the exterior surface of the hand and a region of the hand-retaining device on a side of an interior surface of the hand and is fastened on the hand-retaining device on a first end of the first strip and on a second end of the first strip, wherein the first strip, in a region between its fastening in the region of the hand-retaining device on the side of the exterior surface of the hand on its first end and its fastening in the region of the hand-retaining device on the side of the interior surface of the hand on its second end, is not fastened on the hand-retaining device, wherein the hand-retaining device, between the thumb and the other fingers, comprises a second strip which connects a region of the hand-retaining device on the side of the exterior surface of the hand and a region of the hand-retaining device on the side of the interior surface of the hand, and wherein the first strip overlaps the second strip thereby forming a space.

2. The hand-retaining device as claimed in claim 1, wherein the first strip is formed from an elastic or flexible material, in a first region on the side of the exterior surface of the hand, and is formed from a non-elastic material on the side of the interior surface of the hand.

3. The hand-retaining device as claimed in claim 1, wherein in a region of the hand-retaining device on the side of the exterior surface of the hand, the hand-retaining device is realized at least in part in multiple layers.

4. The hand-retaining device as claimed in claim 1, wherein the first strip is fastened close to the insertion opening for the hand on the region of the hand-retaining device on the side of the exterior surface of the hand, and/or in that the first strip is fastened, on the hand-retaining device on its second end on the side of the interior surface of the hand.

5. The hand-retaining device as claimed in claim 1, wherein the coupling element is realized as a toothed rigid element, a hook-shaped device or a strap or eye.

6. The hand-retaining device as claimed in claim 1, wherein the hand-retaining device comprises a variably securable first fastening device in the region between the insertion opening and the first exit opening.

7. The hand-retaining device as claimed in claim 1, wherein the first strip is a strip which is fastened on the hand-retaining device and is formed from a rubber-elastic material in a first region on the side of the exterior surface of the hand, and is formed from a non-elastic material on the side of the interior surface of the hand.

8. The hand-retaining device as claimed in claim 1, wherein the first strip connecting the region of the hand-retaining device on the side of the exterior surface of the hand and the region of the hand-retaining device on the side of the interior surface of the hand is sewn, on the hand-retaining device on a first end of the first strip and on a second end of the first strip, wherein the first strip, in a region between its fastening in the region of the hand-retaining device on the side of the exterior surface of the hand on its first end and its fastening in the region of the hand-retaining device on the side of the interior surface of the hand on its second end, is not fastened on the hand-retaining device at least in a region of the coupling element, and wherein the second strip connects the region of the hand-retaining device on the side of the exterior surface of the hand and the region of the hand-retaining device on the side of the interior surface of the hand in one piece.

9. The hand-retaining device as claimed in claim 1, wherein in a region of the hand-retaining device on the side of the exterior surface of the hand, the hand-retaining device is realized at least in part in multiple layers, wherein the first strip is sewn, on the hand-retaining device on its first end on the side of the exterior surface of the hand between a first material layer and a second material layer.

10. The hand-retaining device as claimed in claim 1, wherein the first strip is fastened close to the insertion opening for the hand on the region of the hand-retaining device on the side of the exterior surface of the hand, at a maximum distance of between 0.5 and 3 cm from the insertion opening for the hand, and/or in that the first strip is sewn, on the hand-retaining device on its second end on the side of the interior surface of the hand.

11. The hand-retaining device as claimed in claim 1, wherein the coupling element is realized as a toothed rigid element, a hook-shaped device or a flexible strap or eye, wherein the coupling element is realized as a flexible strap or eye, essentially produced from a low-stretch, where applicable plaited material, or from a braided or coated wire-like material.

12. A pole handle for a ski pole, a Nordic walking pole, a cross-country pole or a hiking pole, said pole handle comprising:

a handle body, and a handle head with a hook-shaped device for the fastening of a hand-retaining device as claimed in claim 1 in the form of a hand strap or a glove, wherein the hook-shaped device is fastened on a separate locking module or forms part thereof, wherein the locking module is insertable into a recess of the handle head which is accessible in the axial direction from above, and is fastenable in and/or on the handle head, wherein latching means which are displaceable or rotatable in and/or on the locking module are arranged in such a manner that a strap-shaped, ring-shaped or eye-shaped device, which is essentially pushed from above into the hook-shaped device and is provided on the hand-retaining device, is fixed in a self-locking manner in the hook-shaped device and on the locking module.

13. A pole handle for a pole, said pole handle comprising:

a handle body, and a handle head with a hook-shaped device for the fastening of a hand-retaining device, wherein the hook-shaped device is fastened on a separate locking module or forms part thereof, wherein the locking module is insertable into a recess which is accessible from one hand side and/or from above, and is fastenable in and/or on the handle head, and wherein latching means which are displaceable or rotatable in and/or on the locking module are arranged in such a manner that a strap-shaped, ring-shaped or eye-shaped device, which is essentially pushed from above into the hook-shaped device and is provided on the hand-retaining device, is fixed in a self-locking manner in the hook-shaped device and on the locking module, wherein the locking module is fastened on the handle head by means of at least one first cross pin, which is arranged transversely with respect to the longitudinal axis of the pole handle, and additionally by means of a second cross pin, wherein at least one of the cross pins serves at the same time for fastening a cover on the handle head.

14. The pole handle as claimed in claim 13, wherein the locking module comprises a displaceably and/or rotatably mounted latching block, on or in which latching means are arranged.

15. The pole handle as claimed in 13, wherein an actuating element is developed at least partially so as to form a contour on a top surface of the handle head and/or on a hand side directed to the hand-retaining device, wherein a top surface of the actuating element on the top surface of the handle head in a rest position is integrated at least in part or almost completely in an outside contour of the handle head, which extends in a substantially semicircular or arcuate manner from a tip of the handle head up to a boundary between the handle head and the handle body on a hand side of the handle head.

16. The pole handle as claimed in claim 13, wherein the locking module has an axial spiral spring which is arranged in a cavity of the handle body and is tensioned downward for emergency release and the tension of which is able to be adjusted.

17. The pole handle as claimed in claim 13, wherein the latching means are realized in the form of a retaining lug, which, in a position tensioned downward against the hook-shaped device, defines a region for the strap-shaped, ring-shaped or eye-shaped device which is restricted against a force.

18. The pole handle as claimed in claim 13, wherein the locking module comprises a fixing element, on which the hook-shaped device is arranged, and comprises a latching block on which the latching means are arranged and which is mounted downward in the direction of the longitudinal axis of the pole handle in the handle body by an anchoring element, and comprises a rotatable and/or tiltable actuating element which is realized for releasing the self-locking, wherein the latching block and the actuating element are engaged around by the fixing element and/or are received at least in part in the fixing element.

19. The pole handle as claimed in claim 13, wherein the locking module comprises a displaceably and/or rotatably mounted latching block, on or in which latching means are arranged, wherein the locking module additionally comprises an actuating element which is fastened on the latching block and can be tilted against spring force by releasing the self-locking from the outside.

20. The pole handle as claimed in claim 13, wherein the actuating element is developed at least partially so as to form a contour on a top surface of the handle head and/or on a hand side (H) directed to the hand-retaining device, wherein a top surface of the actuating element on the top surface of the handle head in a rest position, and also during an actuating movement of the actuating element, is integrated at least in part or almost completely in an outside contour of the handle head, which extends in a substantially semicircular or arcuate manner from a tip of the handle head up to a boundary between the handle head and the handle body on a hand side (H) of the handle head.

21. The pole handle as claimed in claim 13, wherein the locking module has an axial spiral spring which is arranged in a cavity of the handle body and is tensioned downward for emergency release and the tension of which is able to be adjusted by an adjusting nut.

22. The pole handle as claimed in claim 13, wherein the latching means are realized in the form of a retaining lug, which has a beveled flank in the insertion direction upward and which, in a position tensioned downward against the hook-shaped device, defines a region for the strap-shaped, ring-shaped or eye-shaped device which is restricted against a force, which adjustable, wherein the retaining lug is mounted so as to be displaceable, wherein displacement, thereby releasing the restricted region, against a defined and adjustable force, is possible upward, and wherein the force is ensured by a spring or a resilient element.

23. The pole handle as claimed in claim 13, wherein the locking module comprises a fixing element, on which the hook-shaped device is arranged, and comprises a latching block on which the latching means are arranged and which is mounted downward in the direction of the longitudinal axis of the pole handle in the handle body by means of an anchoring element, and comprises a rotatable and/or tiltable actuating element which is realized for releasing the self-locking, wherein the latching block and the actuating element are engaged around by the fixing element and/or are received at least in part in the fixing element.

24. The pole handle as claimed in claim 13 in combination with a hand-retaining device for fastening on the pole handle, said hand-retaining device comprising:

an insertion opening for the hand, a first exit opening for the back of the hand, and second exit opening for a thumb, wherein the hand-retaining device also comprises a first strip which is guided between the thumb and other fingers of the hand and on which is provided a coupling element which can be fastened in a releasable mechanism in a self-locking manner in or on the pole handle, wherein the first strip is realized in an elastic manner at least in regions on an exterior hand surface side of the coupling element, wherein the first strip connects a region of the hand-retaining device on a side of the exterior surface of the hand and a region of the hand-retaining device on a side of an interior surface of the hand and is fastened on the hand-retaining device on a first end of the first strip and on a second end of the first strip, wherein the first strip, in a region between its fastening in the region of the hand-retaining device on the side of the exterior surface of the hand on its first end and its fastening in the region of the hand-retaining device on the side of the interior surface of the hand on its second end, is not fastened on the hand-retaining device, wherein the hand-retaining device, between the thumb and the other fingers, comprises a second strip which connects a region of the hand-retaining device on the side of the exterior surface of the hand and a region of the hand-retaining device on the side of the interior surface of the hand, and wherein the first strip overlaps the second strip thereby forming a space.

25. A pole, having a pole handle as claimed in claim 13, and having a hand-retaining device which is fastenable on the pole handle, said hand-retaining device comprising:

an insertion opening for the hand, a first exit opening for the back of the hand and a second exit opening for the thumb, wherein the hand-retaining device also comprises a first strip which is guided between the thumb and the other fingers and on which is provided a coupling element which can be fastened in a releasable mechanism in a self-locking manner in or on the pole handle, wherein the first strip is realized in an elastic manner at least in regions on the exterior hand surface side of the coupling element.

26. The pole as claimed in claim 25 which is a ski pole, a Nordic walking pole, a cross-country pole or a hiking pole.

* * * * *